United States Patent [19]

Jackson, Jr. et al.

[11] 4,011,537

[45] Mar. 8, 1977

[54] COMPOSITE DROPOUT FUSE DEVICE

[75] Inventors: Hiram Solomon Jackson, Jr., Northbrook; Thomas J. Tobin, Morton Grove, both of Ill.

[73] Assignee: S & C Electric Company, Chicago, Ill.

[22] Filed: Nov. 19, 1975

[21] Appl. No.: 633,373

[52] U.S. Cl. ..... 337/171; 337/186

[51] Int. Cl.[2] ..... H01H 71/20

[58] Field of Search ..... 337/158, 159, 186, 168, 337/169, 170, 171, 177, 178, 190

[56] References Cited

UNITED STATES PATENTS

| | | | |
|---|---|---|---|
| 2,067,541 | 1/1937 | Nobuhara | 337/190 |
| 3,611,240 | 10/1971 | Mikulecky | 337/169 |

*Primary Examiner*—George Harris
*Attorney, Agent, or Firm*—Kirkland & Ellis

[57] ABSTRACT

A dropout type fuse cutout is provided having a high current limiting fuse section and a serially connected expulsion fuse section mounted on a conventional dropout toggle linkage arrangement so that fuse action by the expulsion fuse section causes the cutout to dropout and pivot free of the upper terminal. The current limiting fuse section may comprise a helically edge wound fusible member that reduces the terminal-to-terminal distance thereby reducing the length of the current limiting fuse section so that there is a very short external gap. Further, because of the sequential occurence of maximum voltage across the current limiting fuse section and the expulsion fuse section, each section experiences a unique voltage distribution that requires the utilization of insulating skirts on both fuse sections to maintain the external voltage withstand capabilities of the device even though the device is of sufficient overall length to be expected to provide an adequate dielectric path when contaminated or under wet conditions.

8 Claims, 6 Drawing Figures

24
26
30
36
16
34
40
44
42
38
28
100
32
46
106
104
112
114
12
110
22
20
130
134
10
132
142
136
14
56
54
80
52
58
70
60
18
50
62

FIG. 2
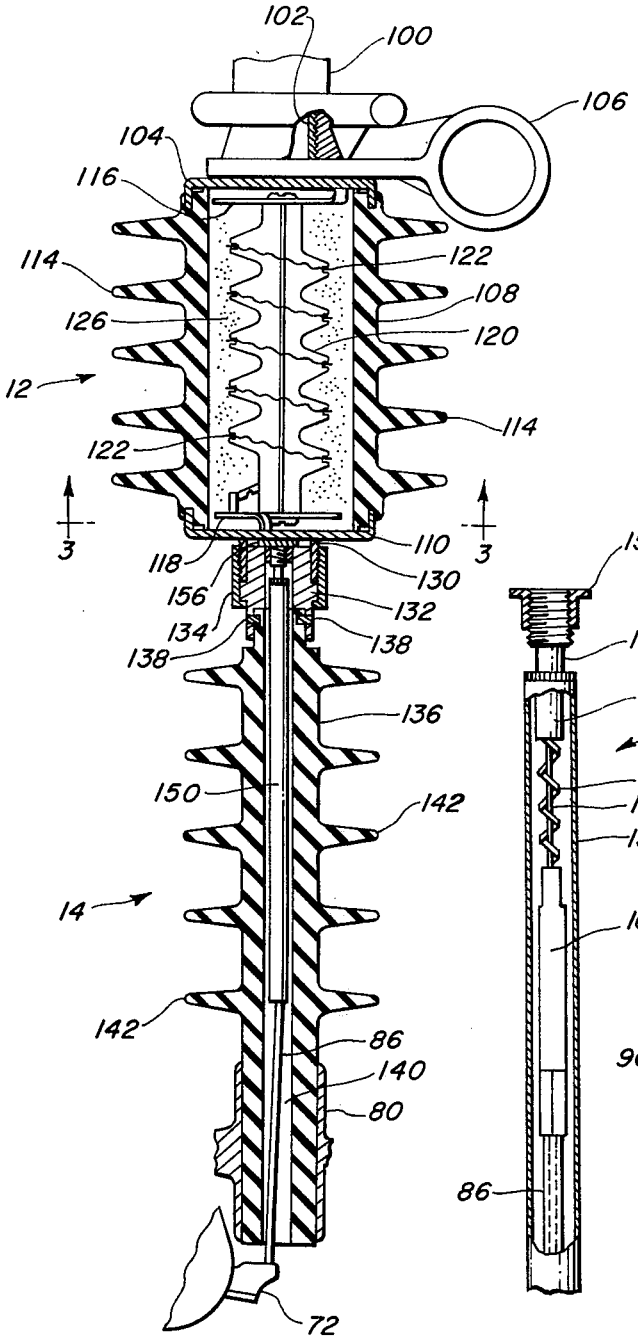
FIG. 3
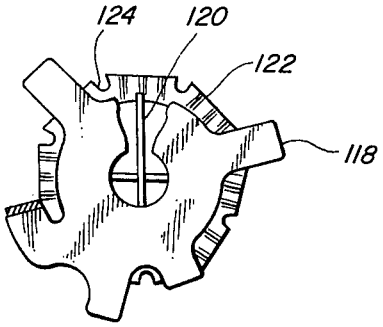
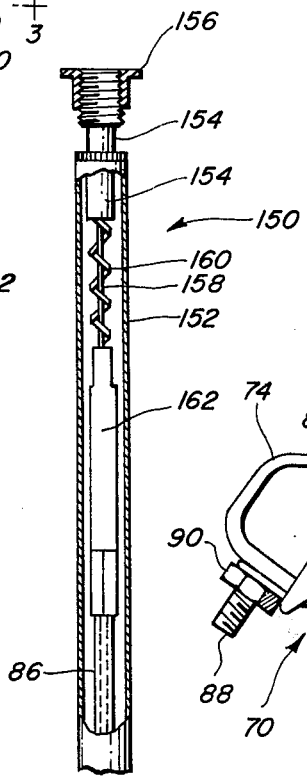
FIG. 4
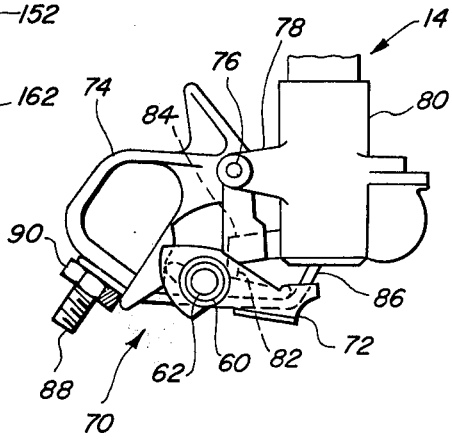
FIG. 5

COMPOSITE DROPOUT FUSE DEVICE

BACKGROUND OF THE INVENTION

1. Field of the Invention

The present invention relates to high voltage dropout type fuse cutout devices and more particularly to a full service dropout fuse comprising a current limiting fuse section operative only during the interruption of heavy fault currents and an expulsion fuse section serially connected to the current limiting fuse section for interrupting lower fault currents such as transformer secondary fault currents.

2. Description of the Prior Art

High voltage dropout fuse cutouts are known to the art as illustrated by U.S. Pat. No. 3,041,426 — Baker issued June 26, 1962 and assigned to the same assignee as the present application. Such dropout type cutouts conventionally comprise a fuse body mounted between two in-line terminals by a toggle linkage arrangement so that upon fuse operation, the toggle linkage operates to permit the fuse body to disengage the upper terminal and pivot free of the upper terminal.

In addition, the serial combination of current limiting fuses with expulsion type fuses to increase the spectrum of current interrupitng capabilities of the fuse device is also known in the art. For example, U.S. Pat. No. 2,917,605 — Fahnoe discloses the serial combination of a current limiting fuse section and an expulsion fuse section. Similarly, U.S. Pat. No. 3,827,010 — Cameron et al. discloses the utilization of a serial combination of a current limiting fuse section and an expulsion fuse section in a conventional dropout type cutout fuse.

However, neither the Fahnoe nor the Cameron et al. patent recognizes that there is a unique voltage distribution that occurs within such a serial combination of a current limiting fuse section and an expulsion fuse section. Thus, even though the overall length of the fuse device may appear to be sufficient to provide adequate external dielectric strength even under contaminated or wet conditions, it has been discovered that additional measures must be taken to provide sufficient external dielectric strength of such devices under contaminated or wet conditions.

SUMMARY OF THE INVENTION

In accordance with the present invention, a high voltage fuse device for interrupting current is provided comprising a current limiting section and a fuse section.

The current limiting section comprises a hollow cylindrical insulating first housing having surface elongating means around the periphery thereof and first and second end walls closing the ends of the first housing. Provided within the first housing is a first fusible member connecting the first and second end wall. The first fusible member comprises current responsive electrically conducting material that it meltable in response to a first current-time characteristic to interrupt current, and the fusible element may advantageously be a flat strip helically edge wound so that the flat sides of the strip are essentially parallel. An edge wound arrangement allows a reduction in the overall length of the current limiting fuse section.

Serially electrically connected to the current limiting fuse section is a fuse section comprising a hollow cylindrical insulating second housing having a surface elongating means around the periphery thereof. A second fusible member is provided within the second housing and the second fusible member is formed of electrically conducting material that is meltable in response to a second current-time characteristic to interrupt current. The second fuse member may conveniently be connected to toggle linkage arrangement so that upon fusion of the second fusible member, the toggle linkage operates to permit the device to drop free of a first terminal mounting. The expulsion fuse section may be of shorter length than would normally be required for a conventional expulsion fuse of comparable voltage rating. This shorter length is suitable because the current limiting section establishes a current maximum which the current through the combination will not exceed. With this maximum current in mind, the expulsion fuse section may be designed with an unconventionally small bore diameter. A relatively short tube having the restricted bore readily interrupts those currents which must be interrupted by the expulsion fuse section.

The overall length of the combined current limiting fuse section and the expulsion fuse section of the present invention is equal to or greater than a standard cutout tube of the same voltage class. This overall length would normally provide adequate external dielectric path even under contaminated or wet conditions. However, there is a unique voltage distribution that occurs within such a combination that necessitates the utilization of surface elongating means such as insulating skirts. The current limiting fuse section must be capable of withstanding the switching surge voltage experienced during fuse action. However, due to the reduced size of the current limiting fuse section resulting from the edge wound configuration of the first fuse member, the external terminal-to-terminal distance across the current limiting fuse portion is insufficient to withstand the surge voltage under certain conditions unless external insulating skirts are added.

The expulsion fuse section, on the other hand, does not experience the initial high voltage portion of the switching surge voltage but does experience full recovery voltage after current interruption, and due to the reduced length of the expulsion fuse section, surface elongating means such as insulator skirts are required to assure freedom from external flashover under certain conditions.

Thus, is is a primary object of the present invention to to provide a composite dropout fuse device having sufficient external dielectric strength to prevent external flashover when it operates even when contaminated or during wet conditions.

It is a further object of the present invention to provide a composite dropout fuse device having a current limiting fuse portion and an expulsion fuse portion serially joined to provide a full spectrum of current interrupting capabilities.

It is a further object of the present invention to provide a composite dropout fuse device including a current limiting fuse section having a helically edge wound fuse element so that the overall terminal-to-terminal length of the current limiting fuse section is less than convention current limiting fuse constructions having comparable voltage ratings.

These and other objects, advantages, and features of the present invention will hereinafter appear, and for the purposes of illustration, but not of limitation, drawings and specifications of an exemplary embodiment are hereinafter presented.

BRIEF DESCRIPTION OF THE DRAWINGS

FIG. 2 is a cross sectional partially fragmentary side view of the embodiment illustrated in FIG. 1.

FIG. 3 is a cross sectional partially fragmentary view taken substantially along line 3—3 in FIG. 2.

FIG. 4 is a segmented partially fragmentary view of the expulsion fuse link illustrated in FIG. 2.

FIG. 5 is a partially fragmentary side view of the toggle linkage arrangement of the embodiment illustrated in FIG. 1.

DESCRIPTION OF THE PREFERRED EMBODIMENT

Figure 1:
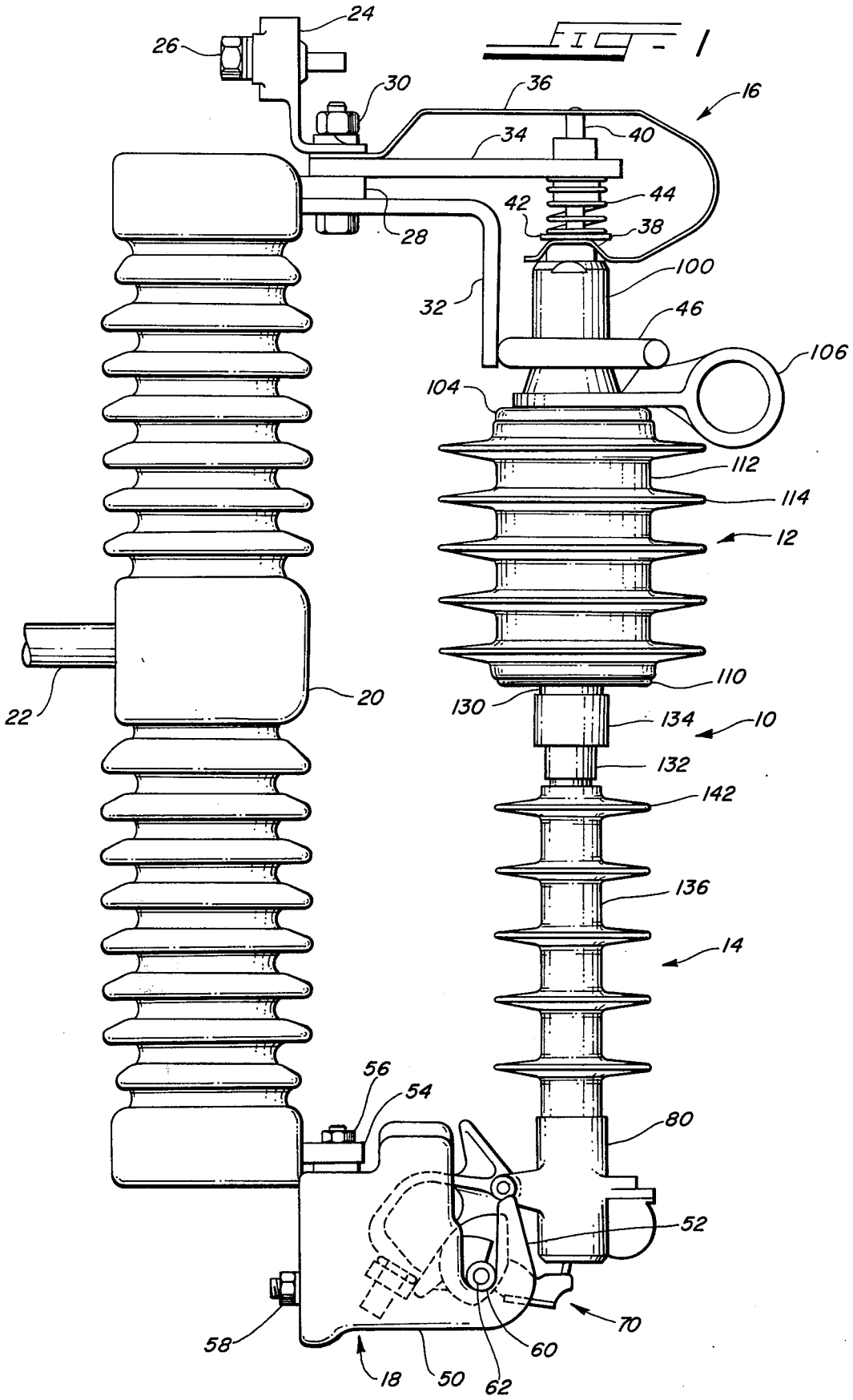
FIG. 1 is a side elevational view of a preferred embodiment of the present invention.

With references to FIG. 1, composite dropout fuse device 10 comprises current limiting fuse section 12 and expulsion fuse section 14 electrically serially connected together. Device 10 is mounted between upper line terminal assembly 16 and lower line terminal assembly 18 which are respectively mounted to opposite ends of insulator 20. Attached at approximately the center of insulator 20 is support arm 22 which can be connected to any appropriate support bracket (not shown) for mounting on a a suitable mounting member such as a utility pole (not shown).

Upper line terminal assembly 16 comprises terminal pad 24 which carries a bolt connector 26 for receiving and clamping an electrical line conductor. Terminal pad 24 is mounted to metallic terminal support 28 by bolt 30. Also mounted to terminal support 28 is L-shaped reinforcing bar 32, recoil bar 34, and U-shaped top contact 36. Formed on the end of U-shaped top contact 36 is recessed fuse engaging indentation 38. Mounted to the free end of recoil bar 34 is contact stud 40, and mounted on the end of contact stud 40 is seat 42. Prestressed spring 44 is positioned around stud 40 between seat 42 and recoil bar 34. Mounted on the end of L-shaped reinforcing bar 32 are forwardly extending arms 46 (only one of which is illustrated) which serve to guide the fuse device into the upper line terminal assembly 16.

Lower line terminal assembly 18 comprises a hinge casting 50 that is formed of a suitable electrically conducting metal. Formed at the end of hinge casting 50 are U-shaped receiving arms 52. Hinge casting 50 is mounted to lower terminal support 54 by bolt 56. Mounted to the back of hinge casting 50 is bolt connector 58 for receiving an electrical line conductor.

With reference to FIGS. 1 and 5, U-shaped receiving arms 52 are adapted to receive trunions 60 mounted on shaft 62 of toggle linkage assembly 70. Toggle linkage assembly 70 is of conventional design and more specifically described in U.S. Pat. No. 3,041,426 — Baker assigned to the same assignee as this application.

With reference to FIG. 5, toggle linkage assembly 70 comprises spring lever 72 privotably mounted on shaft 62. Toggle member 74 is privotably mounted by shaft 76 to arms 78 mounted on bottom ferrule 80 of expulsion fuse section 14. Spring lever 72 is provided with a shoulder 82 (shown in dotted lined) that engages detent 84 extending from the bottom of ferrule 80. A flexible conductor 86 extends from the bottom of expulsion fuse section 14, engages spring lever 72, extends around stud 88, and is clamped securely in position by nut 90.

With reference to FIGS. 1 and 2, current limiting fuse section 12 comprises contact cap 100 mounted to upper threaded adaptor 102 on upper ferrule 104. Contact cap 100 also clamps pull ring 106 firmly against the upper surface of upper ferrule 104. The upper surface of contact cap 100 engages fuse engaging indentation 38 on U-shaped top contact 36. Upper ferrule 104 is firmly mounted over the upper end of hollow cylindrical insulator housing 108, and lower ferrule 110 is firmly mounted over the opposite end of hollow cylindrical insulator housing 108. Formed around the exterior surface of insulator housing 108 are annular insulator skirts 114. Housing 108 can be formed of any suitable electrically insulating material such as various plastic and resins.

Connected to the interior surface of upper ferrule 104 is filament terminator 116, and mounted to the interior surface of lower ferrule 110 is filament terminator 118. Mounted between filament terminators 116 and 118 is support spider assembly 120. Electrically connected at opposite ends to filament terminators 116 and 118 and helically wound around support spider assembly 120 is fusible filament 122. Fusible filament 122 comprises an essentially flat metallic ribbon or strip formed of a material that will melt in response to a predetermined electrical current-time characteristic. Fusible filament 122 is helically wound around support spider assembly 120 essentially on one edge so that the flat surfaces of fusible filament 122 are essentially parallel to one another. To provide a reduced cross sectional area to facilitate fusion during fuse action, indentations 124 (see FIG. 3) are formed around the exterior edge of fusible filament 122. The hollow interior of hollow housing 108 is filled with a granular electrically non-conducting filler material 126 (such as quartz sand). Filler material faciliates current limitation and circuit isolation when fusible filament 122 melts after the current carrying capacity of the fusible filament 122 is exceeded, as is well known in the art.

Mounted to the exterior surface of lower ferrule 110 is lower threaded adaptor 130. Positioned within lower threaded adaptor 130 is upper ferrule 132 of expulsion fuse section 14. Ferrule collar 134 threadably engages lower threaded adaptor 130 to retain ferrule 132 firmly against threaded button 156. Upper ferrule 132 is securely mounted to second insulating housing 136 by pins 138. Insulating housing 136 is essentially cylindrical in shape and has a hollow cylindrical interior 140. Insulating housing 136 can be formed of any suitable electrically insulating material such as plastic resins. In addition, formed around the exterior surface of insulating housing 136 are annular insulator skirts 142. Mounted on the lower end of insulating housing 136 is bottom ferrule 80. Positioned within the hollow cylindrical interior 140 of insulator cutout housing 136 is expulsion fuse link assembly 150.

With reference to FIG. 4, fuse link assembly 150 comprises hollow insulated sheath 152 mounted to threaded ferrule 154. Mounted on threaded ferrule 154 is threaded button 156 that engages the upper edge of ferrule 132. Connected to ferrule 154 is strain wire 158 and fuse element 160. Connected to the lower ends of strain wire 158 and fuse element 160 is lower terminal 162, and connected to lower terminal 162 is flexible conductor 86. Fuse element 160 is formed of any suitable fusible metal that will melt in response to a predetermined electrical current-time characteristic. Strain wire 158 is formed of a material having sufficient strength (such as nichrome) to withstand the force exerted by spring lever 72 on flexible conductor 86.

Fuse device 10 can operate to interrupt a broad spectrum of fault and overload currents. Normally, current flows from bolt connector 26 through top contact 36, contact cap 100, upper ferrule 104, filament terminal 116, fusible filament 122, filament terminator 118, lower ferrule 110, threaded button 156, threaded ferrule 154, fuse element 160 and strain wire 158, lower terminal 162, flexible conductor 86, toggle member 74, and hinge casting 50 to bolt connector 58. When a high fault current is experienced, fusible filament 122 immediately melts and vaporizes and the vapor is absorbed by the filler material 126 to effectively perform the current limiting function. At the same time, fuse element 160 and strain wire 158 of expulsion fuse link assembly 150 fuse thereby allowing spring lever 72 to pivot downwardly to pull flexible conductor 86 towards the bottom of expulsion fuse section 14.

The pivoting of spring lever 72 releases toggle linkage assembly 70 as is more thoroughly described in U.S. Pat. No. 3,041,426 — Baker issued June 26, 1962 and assigned to the same assignee as the present application. As described in U.S. Pat. No. 3,041,426, the pivoting of spring lever 72 permits toggle member 74 to pivot around shaft 76 allowing fuse device 10 to drop downwardly so that contact cap 100 disengages top contact 36 thereby allowing fuse device 10 to pivot on trunions 60 on shaft 62 so that fuse device 10 pivots downwardly to an inverted vertical position.

Similarly, when fault currents are experienced which are not of sufficient magnitude to cause fusible filament 122 in current limiting fuse section 12 to fuse, fuse element 160 and strain wire 158 will nonetheless fuse in expulsion fuse section 14 to affect current interruption and to permit toggle linkage member 70 to operate to allow the fuse device 10 to drop out of top contact 36 as previously described.

It should be noted that since current limiting fuse section 12 and expulsion fuse section 14 are serially connected, fusible element 122 and fuse element 160 must be coordinated in design to assure that fuse element 160 will always fuse at currents which will cause fusion of fusible element 122. If fuse element 160 does not fuse, expulsion fuse section 14 does not operate to cause toggle linkage assembly 70 to operate to allow fuse device 10 to drop out of top contact 36. Thus, there would be no visual indication of fuse operation.

One of the principal advantages of the present invention over the prior art dropout type cutout fuses is that the present invention permits a relatively shorter fuse assembly for a given current capacity. This shorter fuse construction is made possible by the edge winding orientation of the fusible filament 122 in the current limiting fuse section 12. Thus, the overall terminal-to-terminal distance of the current limiting fuse section 12 can be reduced without affecting the interior dielectric strength of the current limiting fuse section 12. This reduced length of the current limiting fuse section 12 permits a longer expulsion fuse section 14 to be utilized for a given distance between line terminal assemblies 16 and 18.

Further, since current limiting fuse section 12 is serially connected to expulsion fuse section 14, expulsion fuse section 14 may be of shorter length than conventional expulsion fuse cutouts of comparable rating. The reason that a shorter expulsion fuse section 14 may be used is that current limiting fuse section 12 limits the maximum current experienced by the expulsion fuse section 14 so that a reduced diameter bore and shorter length housing 136 may be used.

Figure 6:
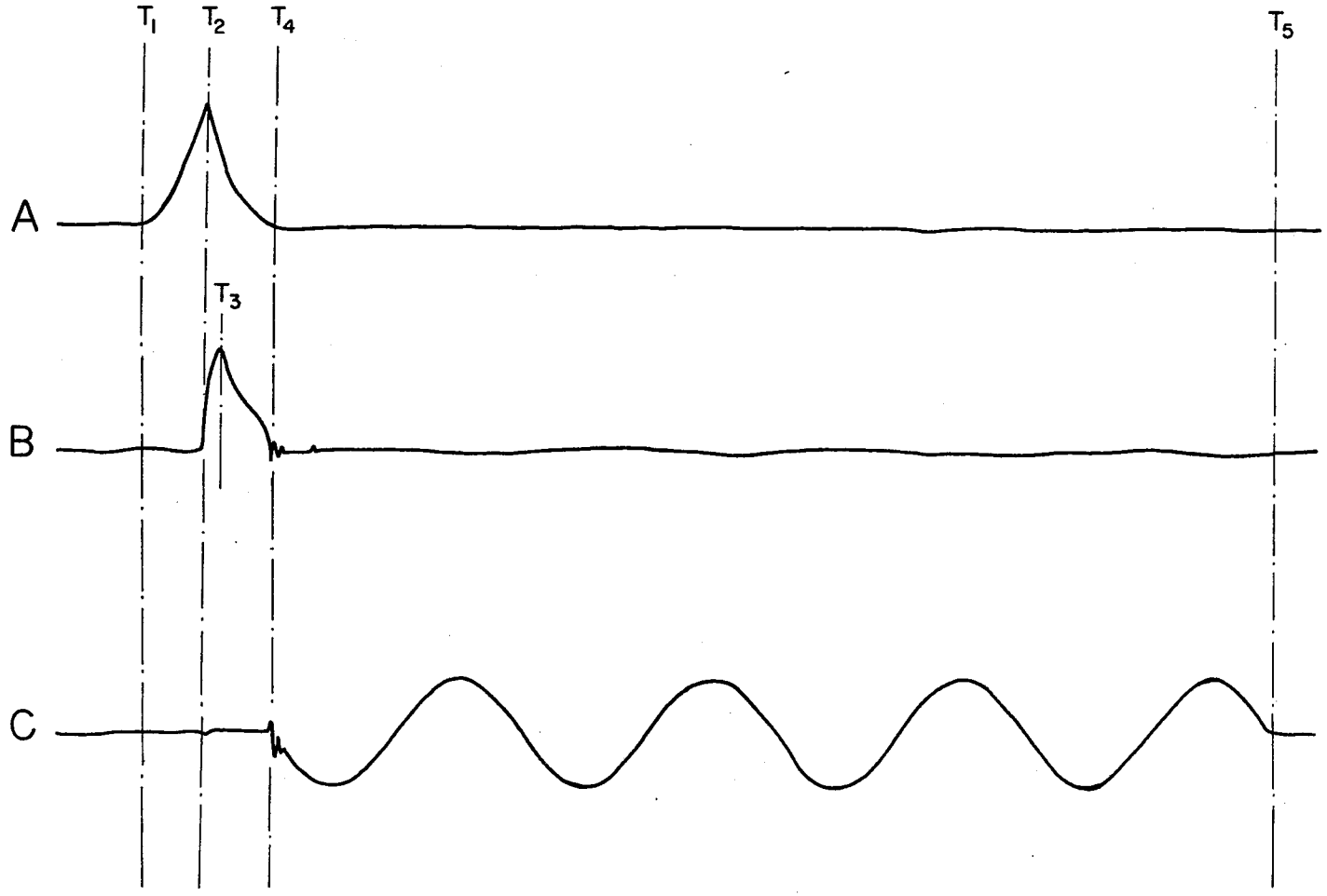
FIG. 6 is a drawing of an oscillogram showing the voltages and currents at various times during fuse operation.

Another primary advantage of the present invention is that the present invention provides increased external dielectric strength of the fuse device 10 over prior art composite dropout fuse devices. In particular, it has been discovered that a unique and unexpected voltage distribution occurs across fuse device 10 during the fuse operation. Ordinarily, fuse device 10 would be thought by one skilled in the art to have sufficient overall length to provide an adequate external dielectric path under even contaminated or wet conditions so as to prevent external flashover during fuse operation. However, due to the composite structure of the fuse device 10, it has been discovered that the crest voltage across current limiting fuse 12 and expulsion fuse section 14 do not occur simultaneously, and accordingly, each experiences a different crest voltage. With reference to FIG. 6, an oscillogram is illustrated of the current (curve A) through fuse device 10, the voltage (curve B) across current limiting section 12, and the voltage (curve C) across expulsion fuse section 14 versus time during fuse operation. Time $T_1$ is the time at which fault current is initiated. At time $T_2$, maximum current is experienced (approximately 6.64 kA) as the fusible element 122 fuses causing the current limiting section 12 to operate to effectively limit the current. The current limiting section experiences the maximum switching surge voltage (curve B) at time $T_3$, and the switching surge voltage diminishes thereafter to essentially zero at time $T_4$. The expulsion fuse section experiences a slight arc voltage (curve C) between time $T_2$ and $T_4$ as fuse element 160 fuses, but does not experience the switching surge voltage. At time $T_4$, and thereafter when the current (curve A) is essentially zero, the series expulsion fuse section experiences the 60 Hz recovery voltage (approximately 15.6 kV) until time $T_5$ when the voltage was removed by a test circuit breaker. In actual field use, the recovery voltage is removed when toggle linkage assembly 70 operates to drop fuse device 10 out of top contact 36. However, it should be noted that the current limiting fuse section 12 does not experience the 60Hz recovery voltage.

Thus, it may be seen that during fuse operation, essentially the entire switching surge voltage is experienced only across the current limiting fuse section 12 which is of a much shorter length than the entire fuse device 10. On the other hand, while the expulsion fuse section 14 does not experience the high voltage portion of the switching surge voltage during fuse operation, it does experience full steady state recovery voltage after current interruption until toggle linkage assembly 70 operates to allow fuse device 10 to drop out of top contact 36. However, this steady state recovery voltage is experienced after the switching surge voltage has subsided. Accordingly, it has been discovered that during contaminated or wet conditions, the external distance across each of current limiting fuse section 12 and expulsion fuse section 14 is not sufficiently long to provide adequate dielectric strength to prevent flashover during fuse operation even though the overall length of fuse device 10 would be adequate to prevent flashover if a single section fuse were used. Accordingly, to increase the external dielectric strength of both the current limiting fuse section 12 and the expulsion fuse 14, surface elongating means in the form of insulator skirts have been added around the exterior of the respective insulating housings of the current limiting fuse section 12 and the expulsion fuse section 14 to provide not only an increased leakage distance external to the unit, but to also provide a barrier to break the partial discharges that might form on the unit during contaminated or wet conditions. While the skirts in this embodiment have been integrally molded to housings 108 and 136, it should be apparent that the skirts could be separately molded on a hollow cylindrical sleeve having an inside diameter equal to the outside diameter of housings 108 and 136 so that the skirted sleeve could be positioned around the housing.

It should be understood that various changes, modifications and variations in the structure and function of the present invention may be affected without departing from the spirit and scope of the present invention as defined in the appended claims.

We claim:

1. A high voltage fuse device for interrupting current between two portions of an electrical circuit comprising:

a current limiting section comprising:

a hollow insulating first housing;

a first end wall mounted to and closing one end of said first housing;

a second end wall mounted to and closing the other end of said first housing;

at least one first fusible member within said first housing electrically connected between said first and second end walls, said first fusible member comprising a current responsive electrically conducting material that is meltable in response to a first current-time characteristic to interrupt current, said first fusible member being formed into a non-linear path within said first housing, the balance of the space within said housing being filled with electrically non-conducting filler material surrounding said first fusible member;

a fuse section serially connected to said current limiting section comprising:

a hollow insulating second housing;

a second fusible member within said second housing and electrically connected to said first fusible member, said second fusible member formed of an electrically conducting material that is meltable in response to a second currenttime characteristic to interrupt current;

said first and second housings each having surface elongating means on the exterior thereof;

whereby a broad spectrum of fault currents can be interrupted without external flashover arcing.

2. A fuse device, as claimed in claim 1, wherein said device is mounted between a first and a second line terminal and a toggle linkage arrangement is attached to said fuse section and pivotally mounted to said second line terminal so that fuse operation of said fuse section causes said toggle linkage arrangement to operate to allow said fuse device to pivot out of engagement with and pivot away from said first line terminal upon fuse operation of said fuse section.

3. A fuse device, as claimed in claim 1, wherein said first fusible member comprises a thin flat strip of electrically conducting material having two opposite flat surfaces that is helically edge wound so that the flat surfaces are essentially parallel.

4. A fuse device, as claimed in claim 1, wherein said surface elongating means comprises annular flanges.

5. A fuse device, as claimed in claim 1, wherein said device is mounted between first and second line terminals and release means is provided to cause said device to disengage said first terminal when said device operates and moves away from said first terminal.

6. A fuse device, as claimed in claim 1, wherein said first current-time characteristic represents a longer time than said second current-time characteristic at a given current magnitude.

7. In a conventional dropout fuse mounting comprising one or more air mounted insulators, an upper line terminal assembly mounted to an upper end of an insulator, a lower line terminal assembly mounted to the lower end of an insulator, a toggle linkage arrangement pivotally mounted on the lower line terminal assembly; an improved high voltage fuse device comprising:

a current limiting section comprising:

a hollow insulating first housing having first and second open ends, and having annular flanges around the periphery thereof;

a first metallic contact member mounted to and closing said first open end of said first housing, said first contact member electrically engaging the upper line terminal assembly;

a second metallic contact member mounted to and closing said second open end of said first housing;

a first fusible member within said first housing electrically connecting said first and second contact members; said first fusible member comprising a thin flat strip having two opposite flat surfaces formed of an electrically conducting material that is meltable in response to a first current-time characteristic to interrupt current, said strip being helically edge wound so that the flat surfaces are essentially parallel;

a hollow insulating second housing having first and second ends and having annular flanges around the periphery thereof;

a first metallic ferrule mounted to and closing the first end of said second housing, said first ferrule connected to said second contact member;

a second metallic ferrule mounted to the opposite end of said second housing, said second ferrule pivotally mounted to the toggle linkage arrangement;

a second fusible member within said second housing electrically connected to said first ferrule, said second fusible member formed of an electrically conducting material that is meltable in response to a second current-time characteristic to interrupt current;

a flexible conductor conncted between said second fusible member and said toggle linkage arrangement so that fusion of said second fusible member causes said toggle linkage arrangement to operate so that the first metallic contact will disengage the upper line terminal assembly so that the fuse device will pivot away from the upper line terminal assembly;

whereby a broad spectrum of overload and fault current can be interrupted without external flashover arcing.

8. An improved fuse device, as claimed in claim 7, wherein the current-time characteristic of said first fusible member represents a longer melting time than the current-time characteristic of said second fusible member at a given current magnitude.

* * * * *